US010180275B2

(12) United States Patent
Koo

(10) Patent No.: US 10,180,275 B2
(45) Date of Patent: Jan. 15, 2019

(54) ICE MAKING DUCT FOR REFRIGERATOR AND ICE MAKING METHOD USING THE SAME

(71) Applicant: Dongbu Daewoo Electronics Corporation, Seoul (KR)

(72) Inventor: Min Bon Koo, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 101 days.

(21) Appl. No.: 14/841,061

(22) Filed: Aug. 31, 2015

(65) Prior Publication Data

US 2016/0370094 A1 Dec. 22, 2016

(30) Foreign Application Priority Data

Jun. 16, 2015 (KR) ..... 10-2015-0085277

(51) Int. Cl.

| | |
|---|---|
| ***F25D 17/06*** | (2006.01) |
| ***F25C 5/20*** | (2018.01) |
| ***F25D 21/08*** | (2006.01) |
| ***F25D 17/08*** | (2006.01) |
| ***F25B 39/02*** | (2006.01) |

(52) U.S. Cl.

CPC ..... *F25D 17/067* (2013.01); *F25B 39/02* (2013.01); *F25C 5/22* (2018.01); *F25D 17/065* (2013.01); *F25D 17/08* (2013.01); *F25D 21/08* (2013.01); *F25C 2400/10* (2013.01); *F25D 2317/061* (2013.01); *F25D 2317/067* (2013.01); *F25D 2400/02* (2013.01)

(58) Field of Classification Search

CPC ..... F25D 17/065; F25D 17/062; F25D 21/14; F25C 1/24; F25C 1/08; F25C 1/04; F25C 5/005; F25C 2400/10

USPC ..... 62/80

See application file for complete search history.

(56) References Cited

U.S. PATENT DOCUMENTS

| | | | |
|---|---|---|---|
| 1,780,930 | A | 11/1930 | Karmazin |
| 1,987,704 | A | 1/1935 | Replogle |
| 2,013,134 | A | 9/1935 | Collins |
| 2,675,687 | A | 4/1954 | Philipp |

(Continued)

FOREIGN PATENT DOCUMENTS

| | | | |
|---|---|---|---|
| JP | 01219481 | A | 9/1989 |
| JP | H11-211328 | A | 8/1999 |

(Continued)

OTHER PUBLICATIONS

Extended European Search Report dated Oct. 26, 2016 issued in corresponding European Patent Application No. 5186861.9.

*Primary Examiner* — Frantz Jules
*Assistant Examiner* — Steve Tanenbaum

(57) ABSTRACT

An ice making duct for a refrigerator unit includes a cooling duct configured to allow cooling air to be movable in a longitudinal direction therein. Both ends of the cooling duct are connected to an ice making chamber such that the cooling air circulates through the ice making chamber. The ice making duct includes an evaporation coil configured to be wound around the cooling duct. The evaporation coil cools air in the cooling duct to generate cooling air through a process of heat exchange with a refrigerant. The ice making duct includes a heater configured to heat frost generated in the cooling duct forming defrosted water.

10 Claims, 7 Drawing Sheets

(56) References Cited

U.S. PATENT DOCUMENTS

| | | | | |
|---|---|---|---|---|
| 3,568,465 | A * | 3/1971 | Jung | F25D 17/065 62/272 |
| 5,009,080 | A * | 4/1991 | Naganuma | A47F 3/0404 454/193 |
| 5,709,096 | A | 1/1998 | Tamai et al. | |
| 8,434,322 | B2 | 5/2013 | Lee et al. | |
| 2003/0101741 | A1* | 6/2003 | Wiseman | F25C 5/22 62/347 |
| 2005/0210909 | A1 | 9/2005 | Kim et al. | |
| 2008/0148761 | A1* | 6/2008 | Venkatakrishnan | F25D 17/065 62/340 |
| 2010/0101257 | A1 | 4/2010 | Lee et al. | |
| 2010/0326096 | A1 | 12/2010 | Junge et al. | |
| 2011/0138849 | A1* | 6/2011 | Hirano | F25B 25/005 62/513 |

FOREIGN PATENT DOCUMENTS

| | | | |
|---|---|---|---|
| KR | 10-2005-0098135 | | 10/2005 |
| KR | 10-2006-0039169 | A | 5/2006 |
| KR | 10-20060094585 | A | 8/2006 |
| KR | 100633149 | B1 | 10/2006 |

* cited by examiner

ICE MAKING DUCT FOR REFRIGERATOR AND ICE MAKING METHOD USING THE SAME

CROSS-REFERENCE TO RELATED APPLICATIONS

The present application claims priority to and the benefit of the Republic of Korea Patent Application Serial Number 10-2015-0085277, entitled ICE MAKING DUCT FOR REFRIGERATOR AND ICE MAKING METHOD USING THE SAME, having a filing date of Jun. 16, 2015, which is herein incorporated by reference in its entirety.

FIELD OF THE INVENTION

The present invention relates to an ice making duct for a refrigerator and an ice making method using the same.

BACKGROUND

A refrigerator unit is a device intended to store food items at low temperatures. The refrigerator unit may be configured to keep food at a temperature necessary to reduce the reproduction rate of bacteria in the food. Perishable food may be optimally refrigerated between 37° F. to 41° F. to allow for food to be stored for a longer period of time than without refrigeration. A refrigerator unit may also freeze food items in a separate compartment at a temperature that is below approximately 0° F. for an indefinite period of time without spoilage.

The inside of a refrigerator unit is cooled by supplying cooling air of a desired temperature that is generated through a heat exchanging operation of a refrigerant based on a refrigerating cycle. The cycle includes a process of compression-condensation-expansion-evaporation. The cooling air supplied to the inside of the refrigerator unit is evenly transferred by a convection current to store food items within the refrigerator at a desired temperature.

In general, a refrigerator body of the refrigerator unit has a rectangular shape with an open front side providing access to a refrigerating chamber and a freezing chamber. Further, hinged doors may be fitted to the front side of the refrigerator body in order to selectively open and/or close openings to the refrigerating chamber and the freezing chamber. In addition, a plurality of drawers, shelves, receiving boxes, and the like may be provided in the refrigerating chamber and the freezing chamber within the refrigerator unit to keep various food items in an optimal state.

Conventionally, refrigerators were configured as a top mount type in which a freezing chamber is positioned above a refrigerating chamber. Recently, bottom freeze type refrigerators position the freezing chamber below the refrigerating chamber to enhance user convenience. In the bottom freeze type refrigerator, the more frequently used refrigerating chamber is positioned so that a user may easily access the chamber without bending over at the waist, as previously required by the top mount type refrigerator.

However, a bottom freeze type refrigerator may lose its design benefits when a user wants to access the lower freezing chamber on a more frequent basis. For example, prepared ice that is stored in the freezing chamber may be a popular item accessed frequently by a particular user. In a bottom freeze type refrigerator, since the freezing chamber is positioned below the refrigerating chamber, the user would have to bend over at the waist in order to open the freezing chamber door to access the ice. To a frequent ice user, uncomfortably accessing the freezing chamber numerous times may outweigh the benefits of providing ease of access to the refrigerating chamber.

In order to solve such a problem, bottom freeze type refrigerators may include a dispenser configured for dispensing ice that is provided in a refrigerating chamber door. In this case, the ice dispenser is also positioned in the upper portion of the refrigerator, and more specifically is located above the freezing chamber. In this case, an ice making device for generating ice may be provided in the refrigerating chamber door or in the interior of the refrigerating chamber.

For example, in the bottom freeze type refrigerator in which the ice making device is installed in the refrigerating chamber door, air (cooling air) cooled by an evaporator is discharged to the freezing chamber and the refrigerating chamber. More specifically, a portion of the cooling air discharged to the freezing chamber side flows to the ice making device along a cooling air supply duct embedded in a sidewall of a main body of the refrigerator. The cooling air subsequently freezes water while flowing within the ice making device. Thereafter, the cooling air within the ice making device is discharged to the refrigerating chamber through a cooling air reducing duct embedded in the sidewall of the main body of the refrigerator. This discharged cooling air is subsequently used to lower an internal temperature of the refrigerating chamber.

However, since the discharged cooling air of the freezing chamber is used first in the ice making device to make ice, as the cooling air moves through the cooling air supply duct and the cooling air reducing duct to reach the refrigerating chamber for lowering its temperature, the supply efficiency of the discharged cooling air may be degraded.

In addition, the ice making device may be inefficient when located in the often accessed refrigerating chamber. That is, the temperature of the cooling air of the freezing chamber side used to freeze ice is undesirably raised every time the refrigerating chamber door is opened. In turn, the discharged cooling air used to lower the temperature of the refrigerating chamber will also be undesirably raised. As such, more cooling cycles are required to make ice in the ice making device located in the refrigerating chamber door when compared to an ice making device located in the freezing chamber, especially when the refrigerating chamber is frequently accessed. Furthermore, because the temperature of discharged cooling air may be undesirably raised by frequent access to the refrigerating chamber, more cooling cycles may also be required to lower temperature of the refrigerating chamber. All of the aforementioned results in increased power consumption of the refrigerator unit.

What is needed is a more efficient way to make ice in a bottom freeze type refrigerator.

SUMMARY

In view of the above, therefore, embodiments of the present invention provide an ice making duct for a refrigerator in which cooling air cooled in a cooling air duct can be directly used to generate ice.

In accordance with one embodiment of the present invention, an ice making duct for a refrigerator unit is disclosed. The ice making duct includes a cooling duct configured to allow cooling air to be movable in a longitudinal direction therein. Both ends of the cooling duct are connected to an ice making chamber such that the cooling air circulates through the ice making chamber. The ice making duct includes an evaporation coil configured to be wound around the cooling duct, wherein the evaporation coil cools air in the cooling duct to generate cooling air through a process of heat exchange with a refrigerant. The ice making duct includes a heater configured to heat frost generated in the cooling duct forming defrosted water.

In accordance with another embodiment of the present invention, an ice making method using an ice making duct of a refrigerator is described. The method includes supplying air to a cooling duct, wherein the cooling duct is configured to have an evaporation coil wound therearound. The method includes supplying a refrigerant to the evaporation coil. The method includes cooling the air in the cooling duct to generate cooling air through a heat exchange process between the air and the refrigerant. The method includes supplying the cooling air to an ice making chamber for making ice. The method includes discharging the cooling air within the ice making chamber into the cooling duct. The method includes recooling the discharged cooling air in the cooling duct.

In accordance with one embodiment of the present invention, a refrigerator is disclosed. The refrigerator includes a freezing chamber located within a main body of the refrigerator. The refrigerator includes a refrigerating chamber located within the main body of the refrigerator. The refrigerator includes at least one refrigerating chamber door configured to isolate the refrigerating chamber from a surrounding environment and to provide access to the refrigerating chamber. The refrigerator includes an ice making chamber installed inside a first refrigerating chamber door. The refrigerator includes an ice making duct configured within a body of the refrigerating chamber. The ice making duct includes a cooling duct configured to allow cooling air to be movable in a longitudinal direction therein, and to have both ends connected to the ice making chamber such that the cooling air circulates through the ice making chamber. The ice making duct includes an evaporation coil configured to be wound around the cooling duct and configured to cool air in the cooling duct to generate cooling air through a process of heat exchange with a refrigerant.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTION

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Figure 1:
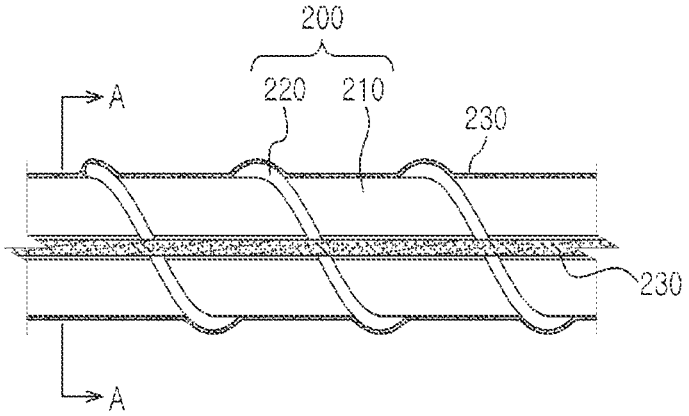
FIG. 1 is a view illustrating a configuration of an ice making duct of a refrigerator unit, in accordance with an embodiment of the present invention.
Figure 2:
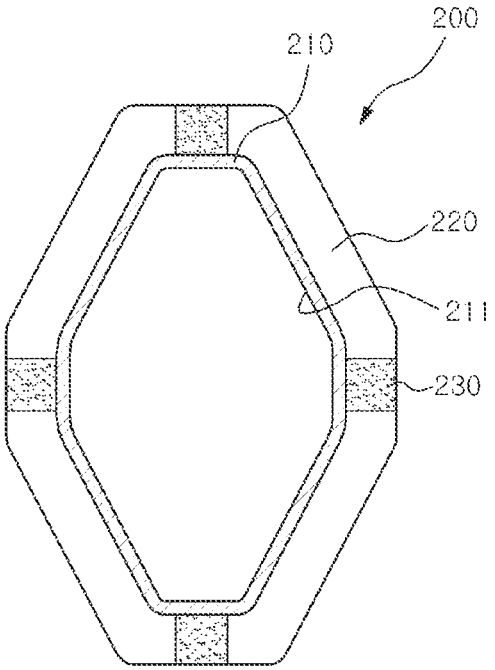
FIG. 2 is a cross-sectional view taken along line A-A of the ice making duct of FIG. 1, in accordance with one embodiment of the invention.
Figure 3:
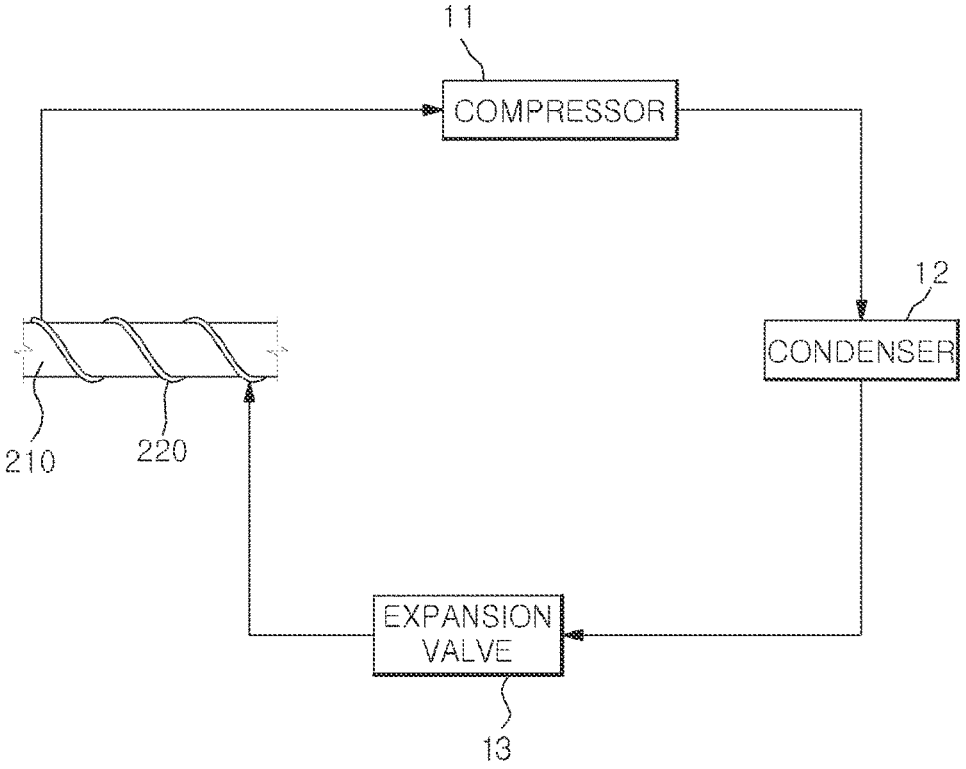
FIG. 3 is a block diagram illustrating a refrigerating cycle of the ice making duct of a refrigerator unit, in accordance with one embodiment of the invention.
Figure 4:
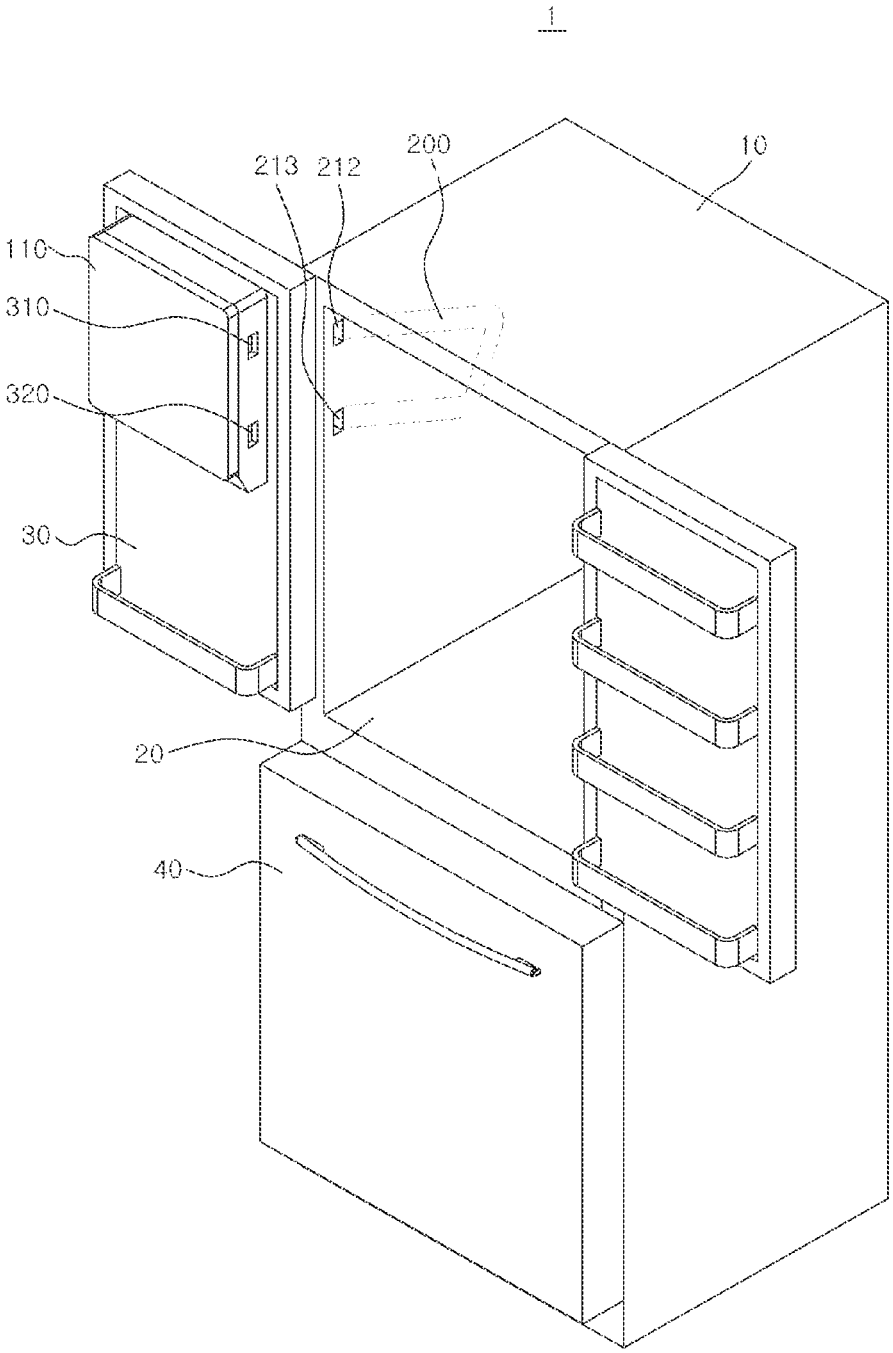
FIG. 4 is a perspective view illustrating a refrigerator unit, in accordance with one embodiment of the present invention.

FIG. 1 is a view illustrating a configuration of an ice making duct of a refrigerator unit, in accordance with one embodiment of the present invention. FIG. 2 is a cross-sectional view taken along line A-A of the ice making duct of FIG. 1, in accordance with one embodiment of the invention. FIG. 3 is a block diagram illustrating a refrigerating cycle of a refrigerator unit utilizing the ice making duct of FIG. 1, in accordance with one embodiment of the present invention. FIG. 4 is a perspective view illustrating a refrigerator unit utilizing the ice making duct of FIG. 1, in accordance with an embodiment of the present invention.

As illustrated in FIGS. 1 to 4, an ice making duct 200 of a refrigerator unit 1 includes a cooling duct 210, in accordance with an embodiment of the present invention. The refrigerator unit 1 may generate ice using cooling air that is cooled in the cooling duct 210.

As shown in FIGS. 1-4, the refrigerator unit 1 may include a main body 10 that may include one or more inner chambers. A barrier 20 separates the interior cavity of the main body 10 into a refrigerating chamber and a freezing chamber. One or more doors may be configured to selectively isolate the interiors of the chambers from the surrounding environment. For example, a refrigerating chamber door 30 is configured for selectively closing a front opening of the refrigerating chamber through contact on edges of a front surface of the main body 10. A freezing chamber door 40 is configured for closing a front opening of the freezing chamber. The refrigerator unit 1 in accordance with this embodiment is a bottom freeze type refrigerator in which the freezing chamber is positioned in a lower portion thereof. Although some embodiments of the present invention are described in view of bottom type freeze type refrigerators, other embodiments of the present invention are not limited thereto, and may be applied to various types of refrigerators.

The refrigerator unit 1 includes an ice making duct 200 configured for moving air. The ice making duct 200 may include a cooling duct 210 in which cooling air is movable in a longitudinal direction therein, an evaporation coil 220 for cooling the cooling duct 210 through conduction, and a heater 230 for heating the cooling duct 210.

More specifically, the cooling duct 210 may include a cooling channel 211, a first duct hole 212, and a second duct hole 213.

The cooling channel 211 is a passage through which cooling air moves, and may extend in a longitudinal direction within the cooling duct 210. In particular, the cooling channel 211 has a length sufficient for generating cooling air. Air moving in the cooling channel 211 for a predetermined period of time may be cooled to generate cooling air having a temperature (e.g., 14 degrees Fahrenheit or lower below zero) sufficient for ice making.

Further, the first duct hole 212 may be provided at one end of the cooling channel 211 to supply the cooling air to the ice making chamber 110. The second duct hole 213 may be provided at the other end of the cooling channel 211 to receive the cooling air from the ice making chamber 110. For example, the first duct hole 212 supplying cooling air may be connected to an upper portion of the ice making chamber 110, and the second duct hole 213 discharging cooling air may be connected to a lower portion of the ice making chamber 110. The cooling air within the cooling duct 210 may move from a lower end of the cooling duct 210 associated with the second duct hole 213 to an upper end thereof that is associated with the first duct hole 212.

The cooling duct 210 may extend to be bent in a vertical direction of the main body 10 (e.g., in a sidewall) such that the cooling duct 210 of ice making duct 200 is sloped in a forward direction of the main body 10 within the refrigerator unit 1. For example, the cooling duct 210 may be bent to have a "⊏" shape or a "C" shape in a forward direction of the main body 10.

In this manner, since the cooling duct 210 is bent to have a "⊏" shape or a "C" shape, when defrosted water is generated within the cooling duct 210, the defrosted water may move to the lowermost portion of the cooling duct 210 and may be subsequently discharged to the outside through a separate drain device (not shown).

The cooling duct 210 is installed in the main body 10 of the refrigerator 1, and the ice making chamber 110 is provided within the refrigerating chamber door 30 of the refrigerator unit 1. Here, the first duct hole 212 and the second duct hole 213 of the cooling duct 210 may be selectively connected to an inlet 310 and an outlet 320 of the ice making chamber 110, respectively, when the refrigerating chamber door 30 is in a closed position.

That is, when the refrigerating chamber door 30 is closed and resting against the main body 10, cooling air within the cooling duct 210 may be introduced to the inlet 310 of the ice making chamber 110 through the first duct hole 212. The cooling air introduced to the ice making chamber 110 may circulate within the ice making chamber 110 to freeze water within the ice making chamber 110 thereby making ice. Thereafter, the cooling air within the ice making chamber 110 may be discharged to the second duct hole 213 of the cooling duct 210 through the outlet 320. The cooling air discharged from the ice making chamber 110 may be recooled as it travels through the cooling duct 210, and then introduced again to the ice making chamber 110 through the inlet 310.

The evaporation coil 220 may cool air as it travels along the length of the cooling duct 210 to generate cooling air through a heat exchange process using a refrigerant. To this end, the evaporation coil 220 is configured to be wound around the cooling duct 210. As such, when the refrigerant circulates through the evaporation coil 220, depending on the refrigerating cycle, the evaporation coil 220 may cool the cooling duct 210 through conduction.

The evaporation coil 220 may serve as an evaporator of the refrigerating cycle. For example, the evaporation coil 220 may implement the refrigerating cycle including a process of compression-condensation-expansion-evaporation, together with a compressor 11, a condenser 12, and an expansion valve 13.

In some embodiments, the compressor 11, the condenser 12, the expansion valve 13, and the evaporation coil 220 are configured to implement a refrigerating cycle for the purpose of supplying cooling air to the ice making chamber 110. In other embodiments, the configuration of the compressor 1, the condenser 12, the expansion valve 13, and the evaporation coil 220 may also provide cooling air to the refrigerating chamber and the freezing chamber of the refrigerator unit 1, as well as to the ice making chamber 110. In addition, the configuration of the compressor 11, the condenser 12, and the expansion valve 13 may also share a refrigerant with an evaporator (not shown) for providing cooling air to the refrigerating chamber and the freezing chamber.

The heater 230 may heat frost generated in the cooling duct 210 which forms defrosted water that may be discharged from the cooling duct 210 through a separate drain device (not shown). To this end, the heater 230 may be a heat transfer tape (e.g., aluminum heat transfer tape) that is adhered to the ice making duct 200 or the cooling duct 210 to provide a heat source to the cooling duct 210.

Although heater 230 of some embodiments of the present invention is described with respect to the heat transfer tape adhered to the surface of the ice making duct 200 or the cooling duct 210, it is not limited thereto. For example, in other embodiments, the heater 230 may also be formed of a heating coil (not shown) that is allowed to be wound around the ice making duct 200 or the cooling duct 210.

The heater 230 is operated, as controlled by a separate timer (not shown), at a predetermined time interval to remove the frost, in one embodiment. In addition, in another embodiment the heater 230 is operated when a temperature of the cooling duct 210, sensed by a separate temperature sensor (not shown), falls below a predetermined temperature, thereby removing the frost.

Figure 5:
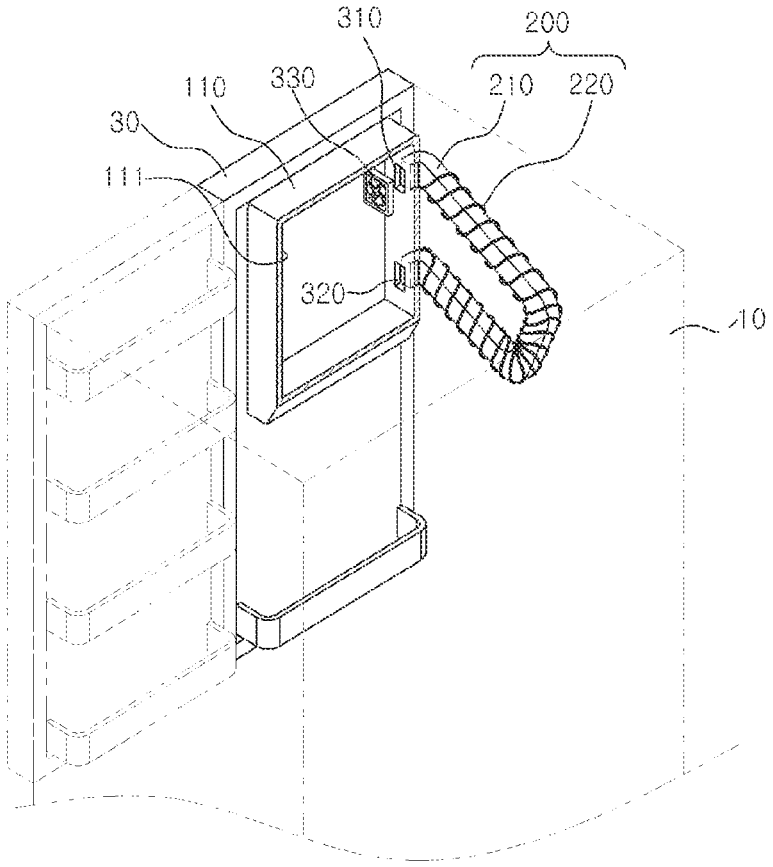
FIG. 5 is a view illustrating a state of connection between an ice making chamber and a cooling duct in a refrigerator unit, in accordance with one embodiment of the present invention.
Figure 6:
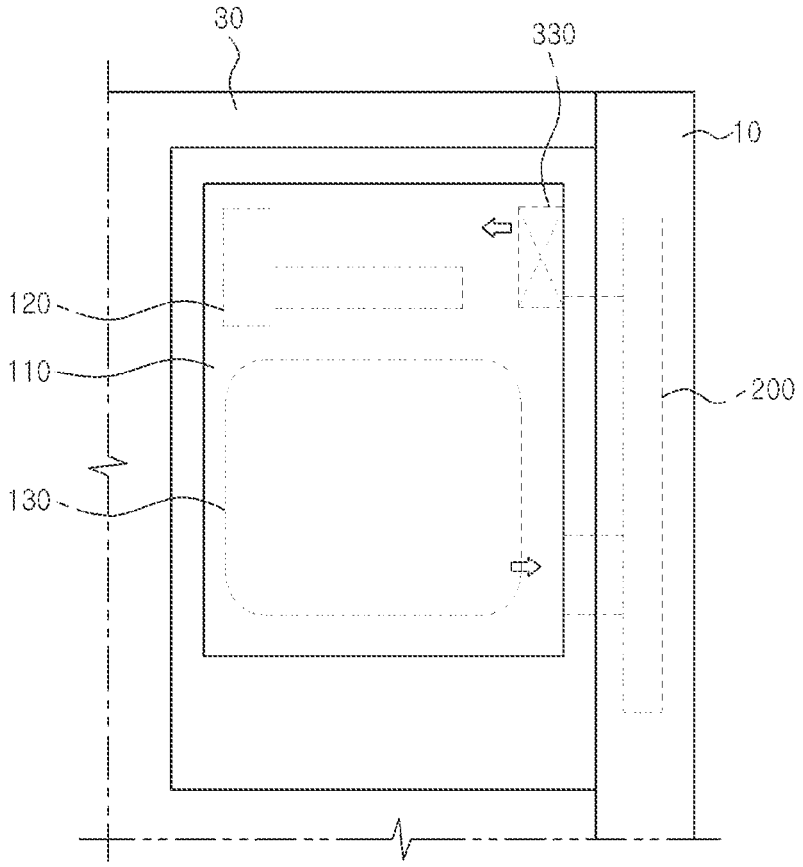
FIG. 6 is a view illustrating an internal configuration of an ice making chamber of a refrigerator unit, in accordance with one embodiment of the present invention.

FIG. 5 is a perspective view illustrating a state of connection between the ice making chamber 110 and the cooling duct 210 in the refrigerator unit 1, in accordance with one embodiment of the present invention. FIG. 6 is a cross-sectional view illustrating an internal configuration of the ice making chamber of the refrigerator unit 1, in accordance with one embodiment of the present invention.

As illustrated in FIGS. 5 and 6, the ice making chamber 110 may be provided in the refrigerating chamber door 30 of the refrigerator unit 1. Although embodiments of the present invention are described having an ice making chamber 110 located in an upper portion of the refrigerating chamber door 30, this is merely illustrative. That is, in other embodiments, the ice making chamber 110 may be installed in other locations inside and outside of the refrigerating chamber door 30.

The ice making chamber 110 may provide an ice making space 111 in which ice is generated. In addition, an ice maker 120, an ice bank 130 for storing ice, and a circulation fan 330 may be provided within the ice making chamber 110.

The ice maker 120 may freeze water into ice using cooling air introduced to the ice making space 111 and dispense the formed ice to the ice bank 130. The ice bank 130 may be positioned below the ice maker 120 from which ice is dispensed. The ice bank 130 may store the dispensed ice and provide the ice to a user through a dispenser unit (not shown). The circulation fan 330 may move the cooling air from the inlet 310 through the ice making chamber 110, and to the outlet 320.

Figure 7:
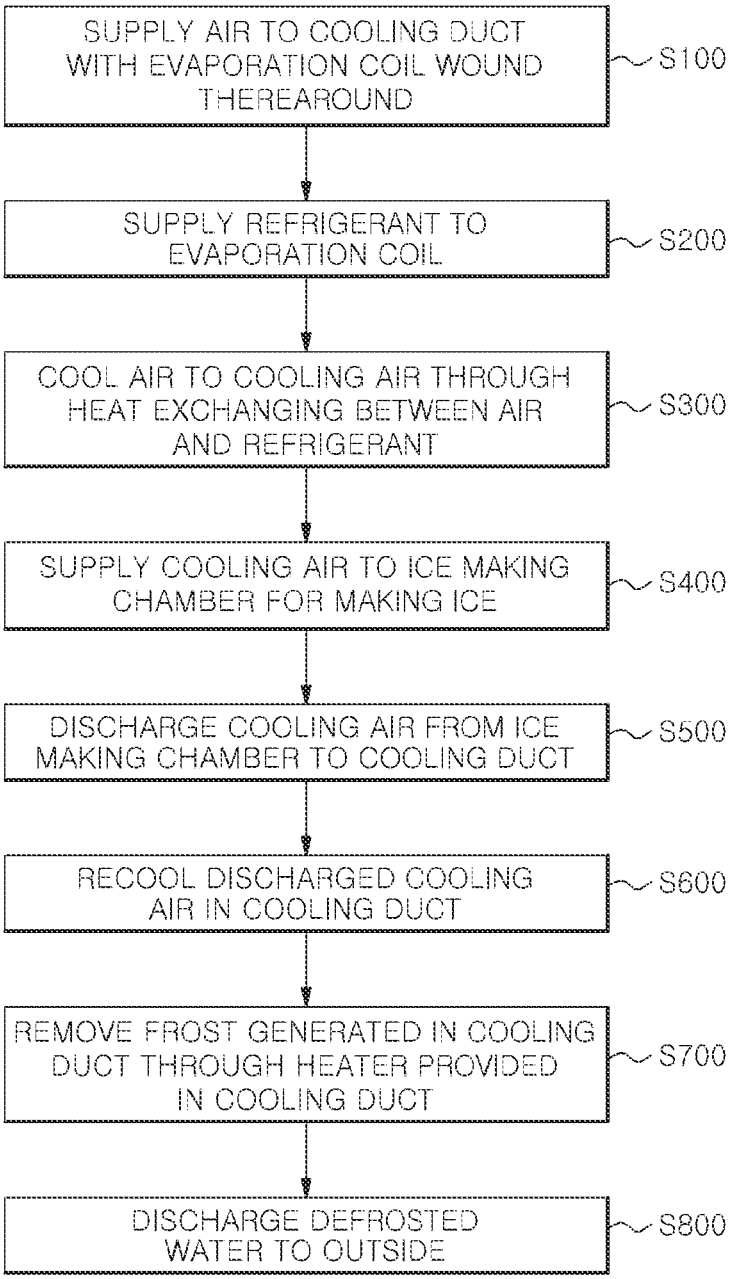
FIG. 7 is a flow diagram illustrating a method for making ice using an ice making duct of a refrigerator unit, in accordance with one embodiment of the present disclosure.

FIG. 7 is a flow diagram illustrating a method for making ice using an ice making duct of a refrigerator unit, in accordance with one embodiment of the present invention. For example, the method outlined in FIG. 7 may be implemented by the ice making duct 200 of refrigerator unit 1 of FIGS. 1-6.

As illustrated in FIG. 7, the ice making method of the refrigerator unit in accordance with one embodiment of the present invention may include the steps of supplying air to a cooling duct with an evaporation coil wound therearound (step S100), supplying a refrigerant to the evaporation coil (step S200), cooling the air in the cooling duct to generate cooling air through a heat exchange between the air and the refrigerant (step S300), supplying the cooling air to an ice making chamber for generating ice (step S400), discharging the cooling air within the ice making chamber to the cooling duct (step S500), recooling the discharged cooling air in the cooling duct (step S600), removing frost generated in the cooling duct through a heater provided in the cooling duct (step S700), and discharging defrosted water to the outside (step S800).

More particularly, in step S100 wherein air is supplied to the cooling duct having evaporation coil wound therearound, air may be supplied to the cooling duct in order to cool the air as it travels through the cooling duct. The air eventually supplied to the interior of the cooling duct may move from a lower end to an upper end of the cooling duct, for example, but may move in the opposite direction in other examples.

In step S200, a refrigerant as implemented within a refrigerating cycle may be supplied to the evaporation coil. In that case, the evaporation coil may implement a refrigerating cycle, including a process of compression-condensation-expansion-evaporation, together with a compressor, a condenser, and an expansion valve.

In step S300 of generating cooling air through a heat exchange process between the air and the refrigerant, air is moved within the cooling duct around which an evaporation coil is wound. As the air travels along the length of the cooling duct, the air is cooled to generate cooling air. Here, while air within the cooling duct moves along a cooling channel, heat from the air may be exchanged with or transferred to the refrigerant via the evaporation coil for a predetermined period of time. As such, the air discharged from the cooling duct and into the ice making chamber may be cooled to cooling air having a temperature (e.g., 14 degrees or lower below zero) sufficient for ice making.

In step S400 of supplying cooling air to the ice making chamber to generate ice, the cooling air that is cooled in the cooling duct may be supplied to an ice making space of the ice making chamber through an inlet of the ice making chamber. The cooling air introduced to the ice making space may circulate in the ice making space through an operation of a circulation fan, thereby freezing water within the ice making space into ice.

In step S500 of discharging cooling air from the ice making chamber to the cooling duct, the cooling air within the ice making space may be discharged to the cooling duct through an outlet of the ice making chamber.

In step S600 of recooling the discharged cooling air in the cooling duct, the discharged cooling air introduced to the cooling duct is moved again along the cooling channel of the cooling duct. The discharged cooling air, or rather air, is moved along the length of the cooling channel for a predetermined period of time so as to be recooled to again generate cooling air having a temperature that is lower than a temperature sufficient for ice making.

In step S700 of removing frost generated in the cooling duct through a heater provided in the cooling duct, the heater is operated by using a timer at a predetermined time interval to remove the frost, in one embodiment. In another embodiment, the heater is operated when a temperature of the cooling duct, as sensed by a temperature sensor, is lower than a predetermined temperature, thereby removing the frost.

In step S800 of discharging defrosted water to the outside, defrosted water that is generated when heating frost in the cooling duct may be discharged to the outside of the refrigerator unit. For example, the defrosted water generated in the cooling duct through heating may be discharged to a defrosting tray (not shown) provided in a machine room of the refrigerator unit through a drain device (not shown) connected to the lowermost portion of the cooling duct.

In accordance with the embodiments of the present invention, since ice is generated using air from the ice making chamber that is directly cooled in a cooling duct, the cooling efficiency of making ice in a refrigerator unit can be enhanced, and the supply efficiency of cooling air can be increased.

In addition, in accordance with the embodiments of the present invention, cooling air circulates between the cooling duct and an ice making space of the refrigerator door for a shorter period of time due to the proximity of the cooling duct to the ice making space, especially when compared to the related art in which cooling air that is cooled in a lower freezing chamber of the refrigerator unit is moved to the ice making space located in a door of an upper refrigerating chamber. As such, the loss of cooling energy in the cooling air can be effectively reduced, and power consumption depending on the operation of the refrigerator can also be reduced since the number of cooling cycles needed to make ice is reduced. As a result, embodiments of the present invention provide a refrigerator unit that is more efficient when making ice.

Thus, according to embodiments of the present invention, method and systems for making ice using an ice making duct are disclosed.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention. Further, it will be understood by those skilled in the art that various changes and modifications may be made without departing from the scope of the invention as defined in the following claims.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

Embodiments according to the invention are thus described. While the present disclosure has been described in particular embodiments, it should be appreciated that the invention should not be construed as limited by such embodiments.

What is claimed is:

1. An ice making duct for a refrigerator, the ice making duct comprising:

a cooling duct configured to allow cooling air to be movable in a longitudinal direction therein and having both ends connected to an ice making chamber such that the cooling air circulates through the ice making chamber;

an evaporation coil configured to be wound around the cooling duct and configured to cool air in the cooling duct to generate cooling air through a process of heat exchange with a refrigerant flowing through the evaporation coil; and a heater configured to heat frost generated in the cooling duct, thereby forming defrosted water, wherein the heater comprises heat transfer tapes configured to provide a heat source to the cooling duct;

wherein the cooling duct is in a sidewall of a body of a refrigerating chamber of the refrigerator and is configured in a C-shape that is open toward a refrigerating chamber door of the refrigerator such that the cooling duct is inclined downward toward a rear wall of the body of the refrigerator, wherein the cooling duct comprises:

a cooling channel configured to extend in a longitudinal direction within the cooling duct such that the cooling air is movable in the cooling duct;

a first duct hole at one end of the cooling channel to supply the cooling air to the ice making chamber; and a second duct hole at the other end of the cooling channel to receive the cooling air from the ice making chamber;

wherein the first duct hole is connected to an inlet disposed on an upper portion of the ice making chamber and the second duct hole is connected to an outlet disposed on a lower portion of the ice making chamber, so that the cooling duct communicates with the ice making chamber when the refrigerating chamber door is closed; and wherein the cooling duct has eight sides in an octagon shape in cross-section, wherein the heat transfer tapes comprise four heat transfer tapes respectively disposed on four of the eight sides at regular intervals.

2. The ice making duct of claim 1, wherein the evaporation coil is configured to serve as an evaporator of a refrigerating cycle and cool the cooling duct through conduction.

3. The ice making duct of claim 1, wherein the heater is controlled by a timer that operates the heater at a predetermined time interval.

4. The ice making duct of claim 1, wherein the heater is operated when a temperature of the cooling duct falls below a predetermined temperature.

5. An ice making method using an ice making duct of a refrigerator, the method comprising:

supplying air to a cooling duct with an evaporation coil wound therearound;

supplying a refrigerant to the evaporation coil;

cooling the air in the cooling duct to generate cooling air through a heat exchange process between the air and the refrigerant;

supplying the cooling air to an ice making chamber for making ice;

discharging the cooling air within the ice making chamber into the cooling duct;

recooling the discharged cooling air in the cooling duct;

removing frost generated in the cooling duct through a heater comprising heat transfer tapes disposed on an outer surface of the cooling duct; and discharging defrosted water to the outside;

wherein the cooling duct is in a sidewall of a body of a refrigerating chamber of the refrigerator and is configured in a C-shape that is open toward a refrigerating chamber door of the refrigerator such that the cooling duct is inclined downward toward a rear wall of the body of the refrigerator, wherein the cooling duct comprises:

a cooling channel configured to extend in a longitudinal direction within the cooling duct such that the cooling air is movable in the cooling duct;

a first duct hole at one end of the cooling channel to supply the cooling air to the ice making chamber; and a second duct hole at the other end of the cooling channel to receive the cooling air from the ice making chamber;

wherein the first duct hole is connected to an inlet disposed on an upper portion of the ice making chamber and the second duct hole is connected to an outlet disposed on a lower portion of the ice making chamber, so that the cooling duct communicates with the ice making chamber when the refrigerating chamber door is closed; and wherein the cooling duct has eight sides in an octagon shape in cross-section, wherein the heat transfer tapes comprise four heat transfer tapes respectively disposed on four of the eight sides at regular intervals.

6. The method of claim 5, wherein the removing frost generated in the cooling duct comprises:

operating the heater for a predetermined time interval to remove the frost.

7. The method of claim 5, wherein the removing frost generated in the cooling duct comprises:

sensing a temperature of the cooling duct; and operating the heater when the sensed temperature falls below a predetermined temperature.

8. The method of claim 5, wherein the cooling the air in the cooling duct to generate cooling air comprises:

moving the cooling air along a cooling channel of the cooling duct for a predetermined period of time to cool the cooling air to a temperature lower than a predetermined temperature.

9. A refrigerator, comprising:

a freezing chamber located within a main body of the refrigerator;

a refrigerating chamber located within the main body of the refrigerator;

at least one refrigerating chamber door configured to isolate the refrigerating chamber from a surrounding environment and to provide access to the refrigerating chamber;

an ice making chamber installed inside a first refrigerating chamber door of the at least one refrigerating chamber door; and an ice making duct configured within a body of the refrigerating chamber, wherein the ice making duct comprises:

a cooling duct configured to allow cooling air to be movable in a longitudinal direction therein, and to have both ends connected to the ice making chamber such that the cooling air circulates through the ice making chamber;

an evaporation coil configured to be wound around the cooling duct and configured to cool air in the cooling duct to generate cooling air through a process of heat exchange with a refrigerant flowing through the evaporation coil; and a heater configured to heat frost generated in the cooling duct, thereby forming defrosted water, wherein the heater comprises heat transfer tapes configured to provide a heat source to the cooling duct;

wherein the cooling duct is in a sidewall of the refrigerating chamber of the refrigerator and is configured in a C-shape that is open toward the at least one refrigerating chamber door of the refrigerator such that the cooling duct is inclined downward toward a rear wall of the body of the refrigerator, wherein the cooling duct comprises:

a cooling channel configured to extend in a longitudinal direction within the cooling duct such that the cooling air is movable in the cooling duct;

a first duct hole at one end of the cooling channel to supply the cooling air to the ice making chamber; and a second duct hole at the other end of the cooling channel to receive the cooling air from the ice making chamber;

wherein the first duct hole is connected to an inlet disposed on an upper portion of the ice making chamber and the second duct hole is connected to an outlet disposed on a lower portion of the ice making chamber, so that the cooling duct communicates with the ice making chamber when the refrigerating chamber door is closed; and wherein the cooling duct has eight sides in an octagon shape in cross-section, wherein the heat transfer tapes comprise four heat transfer tapes respectively disposed on four of the eight sides at regular intervals.

10. The refrigerator of claim 9, wherein the freezing chamber is below the refrigerating chamber.

* * * * *